US009624777B2

(12) United States Patent
Austruy

(10) Patent No.: US 9,624,777 B2
(45) Date of Patent: Apr. 18, 2017

(54) MOBILE MEMBER OF A TURBOMACHINE WHICH COMPRISES MEANS FOR CHANGING THE RESONANCE FREQUENCY OF SAME

(71) Applicant: SNECMA, Paris (FR)

(72) Inventor: Julien Michel Patrick Christian Austruy, Yerres (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 15/110,537

(22) PCT Filed: Jan. 19, 2015

(86) PCT No.: PCT/FR2015/050118
§ 371 (c)(1),
(2) Date: Jul. 8, 2016

(87) PCT Pub. No.: WO2015/107310
PCT Pub. Date: Jul. 23, 2015

(65) Prior Publication Data

US 2016/0333696 A1 Nov. 17, 2016

(30) Foreign Application Priority Data

Jan. 20, 2014 (FR) ..... 14 50424

(51) Int. Cl.
*F01D 7/00* (2006.01)
*F01D 5/10* (2006.01)

(52) U.S. Cl.
CPC ..... *F01D 5/10* (2013.01); *F05D 2220/323* (2013.01); *F05D 2230/232* (2013.01);
(Continued)

(58) Field of Classification Search
CPC ..... F05D 2260/96; F05D 2220/323; F05D 2230/232; F05D 2240/50; F05D 2270/021; F05D 2270/022
(Continued)

(56) References Cited

U.S. PATENT DOCUMENTS 3,032,985 A * 5/1962 Alexander ..... F01D 21/02 60/39.281
4,117,742 A 10/1978 Stein
(Continued)

OTHER PUBLICATIONS

International Search Report Issued Apr. 29, 2015 in PCT/FR2015/050116 Filed Jan. 19, 2015.
(Continued)

*Primary Examiner* — Eric Keasel
*Assistant Examiner* — Jason Mikus
(74) *Attorney, Agent, or Firm* — Oblon, McClelland, Maier & Neustadt, L.L.P.

(57) ABSTRACT

A rotor of an aircraft turbomachine having a main axis A, which includes modifying the critical speed of the rotor, depending on whether the rotational speed of the rotor is lower or higher than a predefined rotational speed, including a component that is capable of occupying a first state or a second state depending on whether the rotational speed of the rotor is lower or higher than the predefined rotational speed, each state of the component corresponding to a critical speed of the rotor, and driving the component to one or the other of the two states thereof, depending on the rotational speed of the rotor, wherein modifying the critical speed of the rotor further includes a component that engages with the drive means and is capable of being deformed elastically between one or the other of two stable forms, each of which corresponds to a state of the component.

10 Claims, 2 Drawing Sheets

(52) U.S. Cl.
CPC ..... *F05D 2240/24* (2013.01); *F05D 2240/50* (2013.01); *F05D 2260/96* (2013.01); *F05D 2300/501* (2013.01)

(58) Field of Classification Search
USPC ..... 416/47, 48, 50, 51, 52, 500
See application file for complete search history.

(56) References Cited

U.S. PATENT DOCUMENTS

| | | | |
|---|---|---|---|
| 4,141,604 | A | 2/1979 | Habermann et al. |
| 2005/0152626 | A1 | 7/2005 | Gerez et al. |

OTHER PUBLICATIONS

French Search Report Issued Oct. 31, 2014 in FR 1450424 Filed Jan. 20, 2014.

* cited by examiner

MOBILE MEMBER OF A TURBOMACHINE WHICH COMPRISES MEANS FOR CHANGING THE RESONANCE FREQUENCY OF SAME

TECHNICAL FIELD

The invention proposes a rotor of an aircraft turbomachine which comprises means for modifying its critical speed, depending on the operating conditions of the turbomachine. The critical speed is defined as the coincidence between the rotational and resonant frequencies of the rotor.

PRIOR ART

A mobile member of a turbomachine, such as a turbomachine rotor, has a critical speed specific thereto. When the rotor rotates at a rotational speed that is very close to this critical speed, the vibrations of the rotor become amplified, which is detrimental to the efficiency of the turbomachine.

Known solutions for limiting these vibrations involve connecting the rotor to the stator of the turbomachine via damping means.

Other known solutions involve reducing the period of time during which the rotor rotates at the rotational speed close to the critical speed. To achieve this, the accelerations or decelerations of the rotor are implemented quickly, which has the disadvantage of applying high mechanical stresses on the rotor, as well as on the whole turbomachine assembly.

These solutions are only partially effective, as they nonetheless subject the turbomachine to significant amplitudes of vibration when the rotor is rotating at a rotational speed close to the critical speed of the rotor.

Document US-2005/152626 describes a device for modifying the critical speed of a guide bearing support of a rotor comprising two mechanical structures with different stiffnesses combined so as to support the bearing, the specific resonant frequencies of which are different. The support also comprises means for modifying the angular position of the structures in relation to each other such that the critical speed of the support is equal to one or the other of two critical speeds of the structures.

This document therefore describes means that require a control member, triggering the change in the relative angular position of the two structures.

The purpose of the invention is to propose a rotor that is capable of rotating at a rotational speed that is always different from the critical speed of the rotor.

DESCRIPTION OF THE INVENTION

The invention proposes a rotor of an aircraft turbomachine having a main axis A, which comprises means for modifying the critical speed of the rotor between a first critical speed and a second critical speed, depending on whether the rotational speed of the rotor is lower or higher than a predefined rotational speed between the first critical speed and the second critical speed, said means for modifying the critical speed of the rotor comprising:

a component that is capable of occupying a first state or a second state depending on whether the rotational speed of the rotor is lower or higher than the predefined rotational speed, each state of the component corresponding to a critical speed of the rotor, and means for driving the component to one or the other of the two states thereof, depending on the rotational speed of the rotor, characterised in that the means for modifying the critical speed of the rotor further comprise a component that engages with the drive means and is capable of being deformed elastically between one or the other of two stable forms, each of which corresponding to a state of said component.

The modification of the critical speed of the rotor of the turbomachine, during operation, allows for the switching from a critical speed to another speed, when the rotational speed of the rotor nears one of the critical speeds.

This prevents the rotor from rotating at a speed corresponding to its critical speed, thus limiting the mechanical stresses within the turbomachine. Moreover, switching can take place quickly.

Preferably, the component consists of a system such as a flexible, inverted cage, providing flexibility or not to the means for modifying the critical speed of the rotor, depending on whether it is in one or the other of the two operating states thereof.

Preferably, the drive means comprise at least one actuating member, which is movably mounted and is capable of moving radially under a centrifugal effect when the rotational speed of the rotor is higher than said predefined rotational speed.

Preferably, the drive means comprise an insert capable of moving along the main axis of the rotor and which is capable of being coupled with the component in order to change the state of the component.

Preferably, the drive means comprise means for transforming the radial movement of the actuating member into an axial movement of the insert.

Preferably, the means for transforming the radial movement of the actuating member comprise two revolving portions facing each other and mobile in relation to each other, between which the actuating member is positioned and the support surfaces of the revolving portions facing each other are inclined in relation to each other.

Preferably, the drive means comprise elastic means for driving the insert towards a position corresponding to the state of the component associated with a critical speed of the rotor that is below the predefined rotational speed.

Preferably, the drive means comprise a main radial orientation wall that is axially convex and linked to the insert. Said convex wall is elastically deformable and capable of occupying two stable forms distributed on either side of a radial plane, passing through a radially outer edge of the convex wall.

Preferably, the means for changing the critical speed of the rotor are produced such that they reduce the critical speed of the rotor when the rotational speed of the rotor is higher than the predefined rotational speed and such that they increase the critical speed of the rotor when the rotational speed of the rotor is lower than the predefined rotational speed.

The invention further proposes an aircraft turbomachine comprising a rotor according to the invention, which is equipped with means capable of modifying the critical speed of the rotor when the rotational speed of the rotor is higher or lower than a predefined rotational speed.

BRIEF DESCRIPTION OF THE FIGURES

Other characteristics and advantages of the invention shall be better understood upon reading the following detailed description given with reference to the appended figures, in which.

DETAILED DESCRIPTION OF THE SPECIFIC EMBODIMENTS

Figure 1:
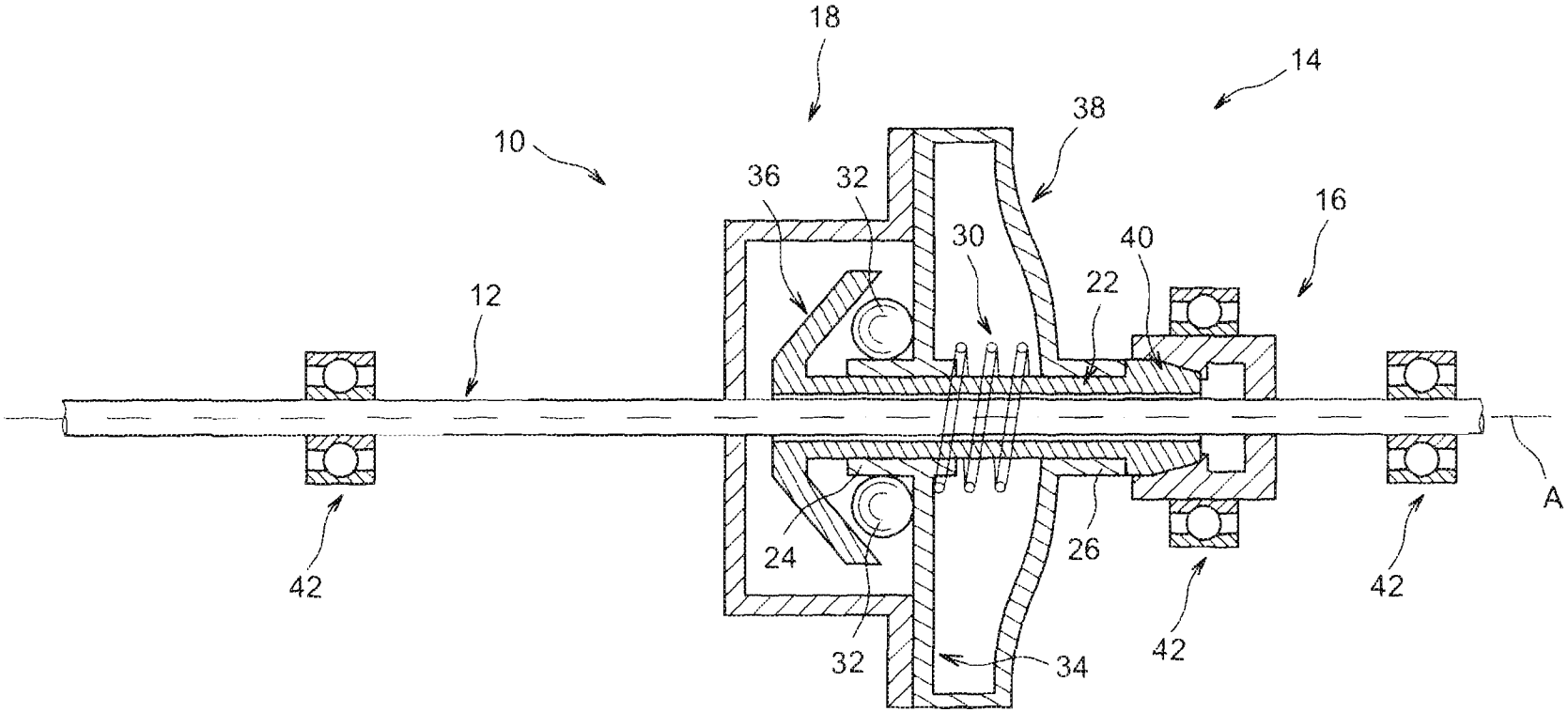
FIG. 1 is a schematic representation of an axial cross-section of a portion of a rotor of the turbomachine produced according to the invention.

FIG. 1 shows a portion of a rotor 10 of an aircraft turbomachine such as a turboprop engine.

It shall be understood that the invention is not limited to a rotor 10 and that the invention can also apply to another component of the turbomachine that is capable of moving in rotation, such as, for example a power transmission shaft.

The rotor 10 comprises a shaft 12 mounted such that it moves in rotation in relation to the stator (not shown) of the turbomachine around the main axis A of the rotor 10. The shaft 12 supports a plurality of components (not shown) of the rotor 10, such as compressor blades or turbine blades.

During turbomachine operation, despite a dynamic balancing of the rotor 10, the rotor 10 and the shaft 12 vibrate at a frequency corresponding to the rotational speed.

The amplitude of these vibrations of the rotor 10 and of the shaft 12 depends on the rotational speed of the rotor 10. In particular, the amplitude of the vibrations increases as the rotational speed of the rotor 10 nears a critical speed of the rotor 10. The critical speed is defined as the coincidence between the rotational and resonant frequencies of the rotor.

This critical speed of the rotor 10 depends on the design of the turbomachine; in particular, it depends on the mass of the components of the rotor 10, as well as on the position of the guide supports of the shaft 12 in rotation in the stator.

If the rotor 10 rotates at this critical speed, the vibrations of the rotor 10 have a high amplitude capable of damaging the rotor 10 or the stator.

In order to prevent the rotor 10 from rotating at a rotational speed close to its critical speed, the rotor comprises means 14 for modifying the critical speed of the rotor 10 when the rotational speed of the rotor 10 nears the critical speed of the rotor 10.

The means 14 for modifying the critical speed of the rotor 10 are produced such as to change the critical speed of the rotor 10 in an almost instantaneous manner, when the rotational speed of the rotor exceeds a predefined rotational speed or when the rotational speed of the rotor 10 falls below the predefined rotational speed.

The means 14 for modifying the critical speed therefore form a system referred to as "bistable", capable of occupying two stable operating states, each stable operating state being associated with a range of rotational speeds of the rotor 10 higher or lower than the predefined rotational speed.

This predefined rotational speed is between a first critical speed, referred to as a lower critical speed, which is the critical speed of the rotor 10 when the means 14 for modifying the critical speed are in a first state, and a second critical speed, referred to as an upper critical speed, which is the critical speed of the rotor 10 when the means 14 for modifying the critical speed are in their second state.

Also, the means 14 for modifying the critical speed are designed such that, when the rotor 10 rotates at a speed lower than the predefined rotational speed, the means 14 for modifying the critical speed are in their second state, and the critical speed of the rotor 10 is therefore the upper critical speed. The rotational speed of the rotor 10 is therefore lower than the upper critical speed defined hereinabove.

However, when the rotor 10 rotates at a speed higher than the predefined rotational speed, the means 14 for modifying the critical speed are in their first state, and the critical speed of the rotor 10 is therefore the lower critical speed. The rotational speed of the rotor 10 is therefore still higher than its lower critical speed defined hereinabove.

Consequently, regardless of the rotational speed of the rotor 10, thanks to the change in state of the means 14 for modifying the critical speed, the rotor 10 cannot reach a rotational speed corresponding to its critical speed.

In order to modify the critical speed of the rotor, the means 14 for modifying the critical speed comprise a component 16, the state of which varies depending on whether the means 14 for modifying the critical speed are in their first state or in their second state.

According to one preferred embodiment, the component 16 is a system such as a flexible, inverted cage, i.e. the flexible cage is coupled to the rotor 10. In a conventional flexible cage system, the flexible cage is coupled to the stator.

The change in state of the flexible cage 16 takes place by its coupling or not with an insert 40. As can be seen in the figures, the insert 40 consists of an element secured to the rotor 10, which is axially mobile in relation to the rotor 10 and in relation to the flexible cage 16 between a coupling position with the flexible cage 16 represented in FIGS. 1 and 2, and a non-coupling position with the flexible cage 16.

The flexible cage 16 is designed such that, when it is coupled with the insert 40, the stresses between the rotor 10 and the stator are transmitted at the level of the flexible cage by the flexible cage 16 and the guide supports of the rotor 10. These two stress paths create a stiffness of the flexible cage 16, which provides the rotor 10 with its upper or lower critical speed.

Therefore, when the insert 40 is coupled with the flexible cage 16, the means 14 for modifying the critical speed are in their second state.

However, when the insert 40 is not coupled with the flexible cage 16, the stresses to be transmitted at the level of the flexible cage 40 can only transit via the flexible cage 16. This single stress path provides the system with flexibility, which provides the rotor 10 with its lower critical speed.

Therefore, when the insert 40 is not coupled with the flexible cage 16, the means 14 for modifying the critical speed are in their first state.

As shown in FIG. 1, the flexible cage 16 is secured to the shaft 12, it is, for example, fixed to the shaft 12 by welding.

The means 14 for modifying the critical speed of the rotor 10 comprise a device 18 for driving the insert 40, which triggers the movement of the insert 40 between a coupling position with the flexible cage 16 and a position wherein the insert is not coupled with the flexible cage 16 when the rotational speed of the rotor 10 exceeds or falls below the predefined rotational speed.

The drive device 18 driving the insert 40 triggers the movement of the insert 40 under the effect of the centrifugal action. Therefore, the drive device 18 is not connected to any control device, which simplifies the integration of the means 14 for modifying the critical speed of the rotor 10.

As shown in the figures, the drive device 18 comprises a cage 20 which is mounted on the shaft 12, and a cylindrical sleeve 22 which is connected to the insert 40.

According to the embodiment shown in the figures, the cylindrical sleeve 22 is mounted such that it moves in relation to the cage 20 in translation along the main axis A of the rotor 10.

The cage 20 and the sleeve 22 are secured to the shaft 12 in rotation and are crossed by the pin 12.

Figure 2:
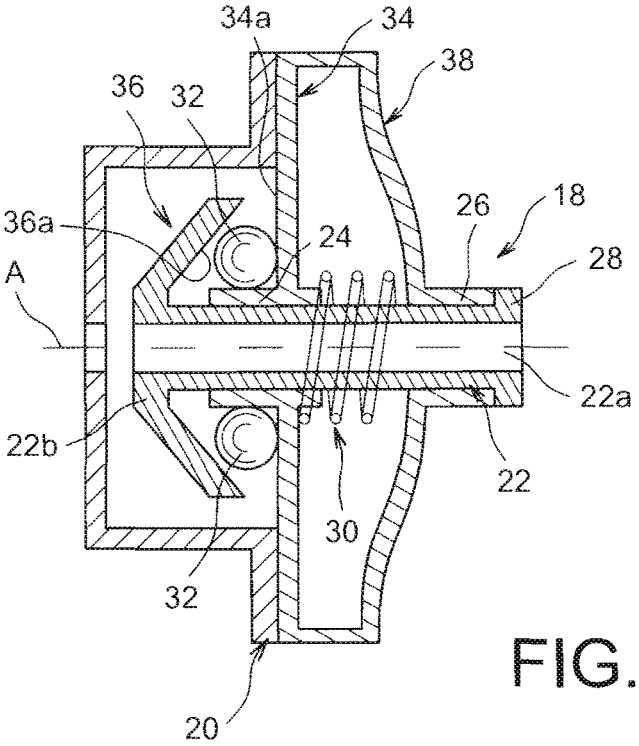
FIG. 2 is a larger scale detailed view of the means for coupling the mobile member with the shaft, represented in the separation position.
Figure 3:
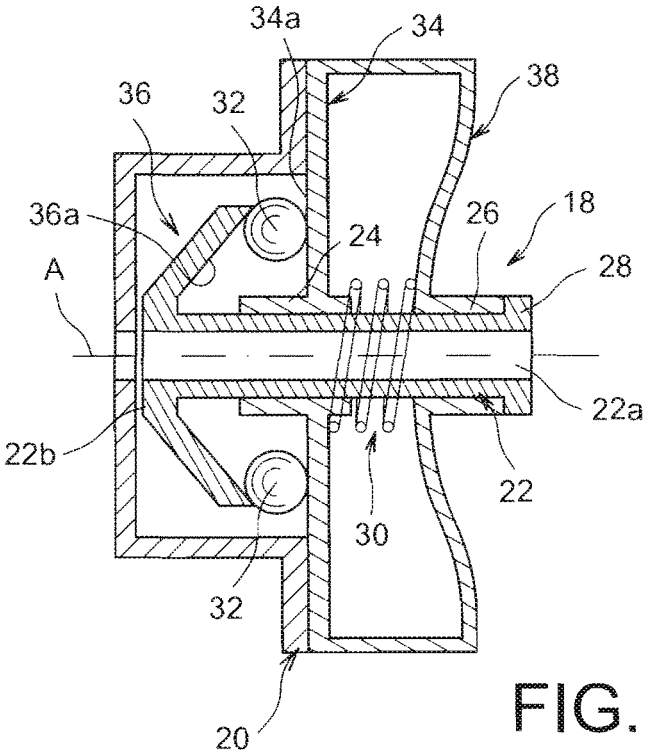
FIG. 3 is a similar view to that in FIG. 2, showing the coupling means in the coupling position.

The cylindrical sleeve 22 is capable of occupying, in relation to the cage 20, a first position shown in FIG. 2, corresponding to the coupling position of the insert 40 with the flexible cage 16 and a second position shown in FIG. 3, corresponding to the position wherein the insert 40 is not coupled with the flexible cage 16.

The movement of the cylindrical sleeve 22 in relation to the cage 20 is guided by a first support 24 secured to the cage 20.

The first support 24 is connected to the rest of the cage 20 via a wall 34 which extends along a radial plane in relation to the axis A.

As stipulated hereinabove, the means 14 for modifying the critical speed of the rotor 10 have a bistable character, i.e. they have two stable operating positions.

The transition between each of the two stable operating positions of the means 14 for modifying the critical speed is achieved by drive means of the cylindrical sleeve 22, which change the position of the sleeve 22 when the rotational speed of the rotor 10 exceeds or falls below the predefined speed.

The bistable character of the means 14 for modifying the critical speed of the rotor 10 is moreover increased by a wall 38 of the cage 20, which is axially convex and which is connected at its centre to the cylindrical sleeve 22 via a second support 26.

The second support 26 is secured to the cylindrical sleeve 22 in axial translation and the wall 38 is capable of becoming elastically deformed during the axial movement of its centre.

As a result of its convex shape, the wall 38 is only able to occupy the two stable forms shown in FIGS. 2 and 3, which are distributed on either side of a radial plane, passing via the radially outer edge of the wall 38. In each of these stable forms, the wall 38 is axially convex in one direction or in the other.

When the wall 38 is elastically deformed in a manner other than in these two stable forms, it has the natural tendency of returning to one of these two forms, dependent on the fact that it is deformed on one side or the other from a hard spot generally corresponding to the point at which its centre is at the same axial level as its radially outer edge.

Therefore, when the rotational speed of the rotor 10 exceeds or falls below the predefined speed, the wall 38 very quickly drives the cylindrical sleeve 22 to one of its two positions, such that the sleeve 22, and therefore the insert 40, remain in an intermediary axial position for a very short period of time.

The convex wall 38 provides the means 14 for modifying the critical speed of the rotor. 10 with a discontinuous character.

The actuation device 18 is designed to drive the cylindrical sleeve 22 in axial movement such that the second support 26 comes through this so-called hard spot when the rotational speed of the rotor 10 becomes equal to the predefined rotational speed for which the means 14 for modifying the critical speed of the rotor 10 change state.

The securing means for securing the second support 26 with the cylindrical sleeve 22L axial displacement in relation to the cage 20, comprise a shoulder 28 of the cylindrical sleeve 22, which is resting in a first direction, in this case to the left, against an opposite axial end of the second support 26. The shoulder 28 is in this example located at an end 22*a* of the cylindrical sleeve located the closest to the component 16.

The means for securing the second support 26 with the cylindrical sleeve 22 further comprise elastic means which continuously exert a bearing force of the second support 26 against the shoulder 28 in the second direction, i.e. to the right.

These elastic means 30 also exert a continuous action for driving the second support 26 towards the stable position of the convex wall 38 shown in FIGS. 1 and 2, corresponding to the second state of the means 14 for modifying the critical speed of the rotor 10, for which the critical speed of the rotor 10 is the upper critical speed.

In this case, the elastic means 30 consist of a compression spring that is compressed between the two supports 24, 26.

The actuation device 18 comprises drive means for driving the cylindrical sleeve 22 in axial displacement towards its second position shown in FIG. 3, when the rotational speed of the rotor 10 becomes greater than the predefined speed, corresponding to the first state of the means 14 for modifying the critical speed of the rotor 10, for which the critical speed of the rotor 10 is the lower critical speed.

These drive means are of the type with centrifugal effect, i.e. they comprise at least one member 32 that is radially mobile in relation to the axis A, which gradually moves radially further away from the axis A as the rotational speed of the rotor 10 increases, by centrifugal effect.

In this case, the drive means comprise multiple mobile members 32, which consist of balls interposed axially between the radial wall 34 which supports the first support 24, and a revolving portion 36 supported by the second end 22*b* of the cylindrical sleeve 22.

This revolving portion 36 extends radially outwards from the second end 22*b* of the cylindrical sleeve 22 and comprises a bearing surface 36*a* located facing a bearing surface 34*a* of the radial wall 34 which supports the first support 24, against which the balls 32 are axially pressing.

The facing bearing surfaces 36*a*, 34*a* of the revolving portion 36 and of the radial wall 34 are inclined in relation to each other, i.e. at least one of these two bearing surfaces 36*a*, 34*a* is conical in shape, and the distance between the bearing surfaces 36*a*, 34*a* while distancing from the main axis A.

Therefore, when the balls 32 move radially outwards, distancing themselves from the main axis A, they press against the bearing surfaces 34*a*, 36*a* and trigger a movement of the cylindrical sleeve 22 in relation to the cage 20 towards its second position.

Via this movement, the cylindrical sleeve 22 drives the second support 26 and causes the elastic deformation of the convex wall 38.

The angle defined by the bearing surfaces 34*a*, 36*a*, the dimensions and the mass of the balls 32, as well as the dimensions of the spring 30 are defined as a function of the predefined rotational speed.

When the rotor 10 rotates at this predefined rotational speed, or at a higher rotational speed, the pressing force of the balls 32 on the walls 34*a*, 36*a* facing each other is greater than the force exerted by the return spring 30 and by the convex wall 38. The cylindrical sleeve 22 is therefore driven axially towards its second position, triggering a change in state of the convex wall 38.

When the convex wall 38 changes state, the elastic return force that it exerts changes direction, the convex wall 38 thus engages with the centrifugal drive means to drive the cylindrical sleeve 22 against the return force exerted by the spring 30.

Therefore, when the rotor 10 rotates at a rotational speed greater than the predefined rotational speed, which is, as stipulated hereinabove, greater than the lower critical speed of the rotor 10, the cylindrical sleeve 22 is driven towards its second position, for which the insert 40 is not coupled with the flexible cage 16, which is therefore in its state with clearance. The means 14 for modifying the critical speed are in their first state, associated with the lower critical speed of the rotor 10.

Consequently, the rotor 10 rotates at a speed greater than the critical speed of the rotor 10.

However, when the rotational speed of the rotor 10 becomes lower than this predefined rotational speed, the force exerted by the return spring 30 is greater than the force exerted by the balls 32 on the facing walls 34*a*, 36*a* and by the return force of the convex wall 38. The cylindrical sleeve 22 is thus driven by the spring 30 and the convex wall 38 towards its position shown in FIGS. 1 and 2.

Therefore, when the rotor 10 rotates at a rotational speed lower than the predefined rotational speed, which is, as stipulated hereinabove, lower than the upper critical speed of the rotor 10, the cylindrical sleeve 22 is driven towards its position, for which the insert 40 is coupled with the flexible cage 16, which is therefore in its state without clearance. The means 14 for modifying the critical speed are in their second state, associated with the upper critical speed of the rotor 10.

Consequently, the rotor 10 rotates at a rotational speed that is lower than the critical speed of the rotor 10.

The combination of the drive means under centrifugal effect with the fast deformation of the convex wall 38 allow the cylindrical sleeve 22 to be quickly driven towards its position shown in FIG. 3. This consequently allows for the insert 40 to be quickly withdrawn from the flexible cage 16, in order to modify the critical speed of the rotor 10.

The rotor 10 further comprises guide bearings 42, three of which are provided in this example, which guide the shaft 12, the means 14 for modifying the critical speed of the rotor 10, and the flexible cage 16 in rotation.

A first bearing 42 is arranged at an upstream portion of the shaft 12, according to the direction of flow of the gases in the turbomachine, in this case on the right-hand side of the figures. This first bearing 42 is located at the turbomachine's intake casing.

The two other bearings 42 are arranged on either side of a low pressure turbine of the turbomachine.

The second bearing 42, which is arranged at a downstream portion of the shaft 12, is connected to an exhaust casing of the low pressure turbine.

The third bearing 42, which is located between the two other bearings 42, is connected to the flexible cage 16 and is connected to an inter-turbine casing.

According to an alternative embodiment, the component 16 is a moving mass, which can be selectively coupled or not coupled to the shaft 12 via means 14 for modifying the critical speed or which can be axially moved by the means 14 for modifying the critical speed.

The change in state of the moving mass 16 thus consists in a selective coupling, or a movement of the moving mass 16, and allows the critical speed of the rotor 10 to be modified as described hereinabove.

The invention claimed is:

1. A rotor of an aircraft turbomachine having a main axis A, which comprises means for modifying a critical speed of the rotor between a first critical speed and a second critical speed, depending on whether the rotational speed of the rotor is lower or higher than a predefined rotational speed between the first critical speed and the second critical speed, said means for modifying the critical speed of the rotor comprising:

a component that is capable of occupying a first state or a second state depending on whether the rotational speed of the rotor is lower or higher than the predefined rotational speed, each state of the component corresponding to a critical speed of the rotor, and means for driving the component towards one or the other of the two states thereof, depending on the rotational speed of the rotor, wherein the means for modifying the critical speed of the rotor further comprise a component that engages with the drive means and is capable of being deformed elastically between one or the other of two stable forms, each of which corresponding to a state of said component.

2. The rotor according to claim 1, wherein the component consists of a system such as a flexible, inverted cage, providing flexibility or not to the means for modifying the critical speed of the rotor, depending on whether it is in one or the other of the two operating states thereof.

3. The rotor according to claim 1, wherein the drive means comprise at least one actuating member, which is movably mounted and is capable of moving radially under a centrifugal effect when the rotational speed of the rotor is higher than said predefined rotational speed.

4. The rotor according to claim 1, wherein the drive means comprise an insert capable of moving along the main axis of the rotor and which is capable of being coupled with the component in order to change the state of the component.

5. The rotor according to claim 4, wherein the drive means comprise means for transforming the radial movement of the actuating member into an axial movement of the insert.

6. The rotor according to claim 5, wherein the means for transforming the radial movement of the actuating member comprise two revolving portions facing each other and mobile in relation to each other, between which the actuating member is positioned and in that the support surfaces of the revolving portions facing each other are inclined in relation to each other.

7. The rotor according to claim 4, wherein the drive means comprise elastic means for driving the insert towards a position corresponding to the state of the component associated with a rotational speed of the rotor that is below the predefined rotational speed.

8. The rotor according to claim 4, wherein the drive means comprise a main radial orientation wall that is axially convex and linked to the insert, and in that said convex wall is elastically deformable and capable of occupying two stable forms distributed on either side of a radial plane, passing through a radially outer edge of the convex wall.

9. The rotor according to claim 1, wherein the means for changing the critical speed of the rotor are produced such that they reduce the critical speed of the rotor when the rotational speed of the rotor is higher than the predefined rotational speed and such that they increase the critical speed of the rotor when the rotational speed of the rotor is lower than the predefined rotational speed.

10. An aircraft turbomachine comprising a rotor according to claim 1, which is equipped with means capable of modifying the critical speed of the rotor when the rotational speed of the rotor is higher or lower than a predefined rotational speed.

* * * * *